US010873161B2

(12) United States Patent
Henry et al.

(10) Patent No.: US 10,873,161 B2
(45) Date of Patent: Dec. 22, 2020

(54) RECEPTACLE ASSEMBLY HAVING CABLED RECEPTACLE CONNECTOR

(71) Applicant: TE CONNECTIVITY CORPORATION, Berwyn, PA (US)

(72) Inventors: Randall Robert Henry, Lebanon, PA (US); Brandon Michael Matthews, McAlisterville, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/404,103

(22) Filed: May 6, 2019

(65) Prior Publication Data

US 2020/0358228 A1 Nov. 12, 2020

(51) Int. Cl.
*H01R 13/6595* (2011.01)
*H01R 12/71* (2011.01)
*H01R 13/6581* (2011.01)

(52) U.S. Cl.
CPC ..... *H01R 13/6595* (2013.01); *H01R 12/716* (2013.01); *H01R 13/6581* (2013.01)

(58) Field of Classification Search
CPC .... H01R 12/00; H01R 12/724; H01R 12/716; H01R 13/6595; H01R 13/6581
USPC ..... 439/79
See application file for complete search history.

(56) References Cited

U.S. PATENT DOCUMENTS 6,095,843 A * 8/2000 Kaneko ..... H01R 13/6275 439/352
6,527,578 B2 * 3/2003 Kashiyama ..... H01R 13/641 439/352
6,537,098 B2 * 3/2003 Kashiyama ..... H01R 13/641 439/352
6,739,759 B1 * 5/2004 Seeley ..... G02B 6/3849 385/60
6,771,511 B2 8/2004 Bui
6,866,532 B1 * 3/2005 Huang ..... H01R 13/6272 439/344
6,890,205 B1 * 5/2005 Wu ..... H01R 13/6275 439/108
7,311,753 B2 12/2007 Bruske
7,322,753 B2 1/2008 Mizue et al.
7,410,365 B2 * 8/2008 Wu ..... H01R 13/512 439/358
7,766,677 B2 * 8/2010 Chiang ..... H01R 13/648 439/140

(Continued)

FOREIGN PATENT DOCUMENTS

WO 2016/179263 A1 11/2016
WO 2017171790 A1 10/2017

*Primary Examiner* — Peter G Leigh

(57) ABSTRACT

A cabled receptacle connector includes a receptacle housing having a cavity extending between a front and a rear of the receptacle housing and a mating slot at the front. The cavity receives a cable assembly with contacts positioned in the mating slot. The cable receptacle connector includes a latch coupled to the receptacle housing. The receptacle housing includes a latch mount and a cover removably coupled to the latch mount and a securing plate coupled to the latch mount and the cover to secure the cover to the latch mount. The cable receptacle connector includes a biasing spring coupled to the latch and the receptacle housing and forward biasing the receptacle housing in the receptacle cage when the latching tab is latchably coupled to the receptacle cage.

20 Claims, 12 Drawing Sheets

(56) References Cited

U.S. PATENT DOCUMENTS

| | | | | |
|---|---|---|---|---|
| 8,267,712 | B2 * | 9/2012 | Huang | H01R 43/26 439/344 |
| 8,454,381 | B2 * | 6/2013 | Wu | H01R 13/504 439/352 |
| 8,475,208 | B2 | 7/2013 | Simpson et al. | |
| 8,523,595 | B2 * | 9/2013 | Wu | H01R 13/633 439/352 |
| 8,905,442 | B2 * | 12/2014 | Ishigami | H01R 13/627 292/128 |
| 9,011,177 | B2 * | 4/2015 | Lloyd | H01B 11/00 439/607.47 |
| 9,354,405 | B2 | 5/2016 | Yeh | |
| 9,389,368 | B1 | 7/2016 | Sharf | |
| 9,437,949 | B2 | 9/2016 | Behziz et al. | |
| 9,484,678 | B1 | 11/2016 | Briant et al. | |
| 9,825,387 | B2 * | 11/2017 | Cheng | G06F 1/183 |
| 9,825,403 | B2 * | 11/2017 | De Dios Martin | H01R 13/633 |
| 9,960,553 | B2 * | 5/2018 | Regnier | H01R 25/006 |
| 9,985,367 | B2 | 5/2018 | Wanha et al. | |
| 10,114,182 | B2 * | 10/2018 | Zbinden | G02B 6/4268 |
| 10,193,280 | B2 | 1/2019 | Sutter et al. | |
| 10,261,269 | B2 * | 4/2019 | Moriyama | G02B 6/4478 |
| 2012/0190224 | A1 * | 7/2012 | Wu | H01R 13/633 439/157 |
| 2012/0218720 | A1 * | 8/2012 | Wu | H01R 13/6275 361/740 |
| 2015/0162709 | A1 * | 6/2015 | Shen | H01R 13/6272 439/352 |
| 2017/0077643 | A1 | 3/2017 | Zbinden et al. | |
| 2017/0288330 | A1 | 10/2017 | Cheng et al. | |
| 2017/0294721 | A1 | 10/2017 | Pao et al. | |
| 2018/0166807 | A1 | 6/2018 | Boyd et al. | |
| 2018/0166827 | A1 * | 6/2018 | Little | G02B 6/4293 |

* cited by examiner

RECEPTACLE ASSEMBLY HAVING CABLED RECEPTACLE CONNECTOR

BACKGROUND OF THE INVENTION

The subject matter herein relates generally to communication systems and receptacle assemblies for communication systems.

Communication systems are known to have receptacle assemblies mounted to host circuit boards. The communication systems typically include a board mounted receptacle connector mounted directly to the host circuit board within a receptacle cage. The receptacle connector has contacts including mating ends defining a mating interface for mating with pluggable modules and terminating ends that are terminated directly to the host circuit board. Signal paths are defined from the pluggable modules to the host circuit board through the signal contacts of the receptacle connectors. However, known receptacle assemblies are not without disadvantages. For example, the electrical signal paths through the host circuit board routed to another electrical component may be relatively long leading to problems with signal loss along the electrical signal paths.

Some known communication systems utilize receptacle connectors having cables terminated to the signal contacts rather than terminating the signal contacts directly to a host circuit board. However, incorporating such cabled receptacle connectors into a receptacle cage is problematic. Removal and/or replacement of such cabled receptacle connectors is problematic.

A need remains for a cost effective and reliable receptacle assembly for a communication system.

BRIEF DESCRIPTION OF THE INVENTION

In one embodiment, a cabled receptacle connector is provided for a receptacle assembly including a cable assembly including a frame holding contacts terminated to cables of the cable assembly. The cable receptacle connector includes a receptacle housing having a cavity extending between a front and a rear of the receptacle housing. The receptacle housing has a mating slot at the front. The cavity receives the cable assembly with the contacts positioned in the mating slot for mating engagement with a pluggable module removably received in a receptacle cage of the receptacle assembly. The receptacle housing includes a latch mount and a cover removably coupled to the latch mount and a securing plate coupled to the latch mount and the cover to secure the cover to the latch mount. The cable receptacle connector includes a latch coupled to the receptacle housing having a latching tab configured to be latchably coupled to the receptacle cage. The cable receptacle connector includes a biasing spring having a first end coupled to the latch and a second end coupled to the receptacle housing. The biasing spring forward biases the receptacle housing in the receptacle cage when the latching tab is latchably coupled to the receptacle cage.

In another embodiment, a receptacle assembly is provided including a receptacle cage and a cabled receptacle connector. The receptacle cage includes a plurality of walls defining a module channel extending between a front and a rear of the receptacle cage. The plurality of walls includes a top wall, a first side wall extending from the top wall to a bottom of the receptacle cage and a second side wall extending from the top wall to the bottom. The module channel is open at the front to receive a pluggable module therein and open at the rear to receive the cabled receptacle connector. The receptacle cage has a latching guide at the rear including a latching feature. The latching guide being separate and discrete from the plurality of walls and is coupled to the first side wall and the second side wall. The cabled receptacle connector is received in the module channel at the rear of the receptacle cage. The cabled receptacle connector includes a cable assembly including a frame holding contacts terminated to cables of the cable assembly and having mating ends configured to be mated with the pluggable module. The cabled receptacle connector includes a receptacle housing having a cavity extending between a front and a rear of the receptacle housing. The receptacle housing has a mating slot at the front. The cavity receives the cable assembly with the contacts positioned in the mating slot for mating engagement with the pluggable module. The cabled receptacle connector includes a latch coupled to the receptacle housing having a latching tab latchably coupled to the latching feature of the latching guide to secure the cabled receptacle connector in the receptacle cage. The cabled receptacle connector includes a biasing spring having a first end coupled to the latch and a second end coupled to the receptacle housing. The biasing spring forward biases the receptacle housing in the receptacle cage when the latching tab is latchably coupled to the latching feature.

In a further embodiment, a communication system is provided including a receptacle assembly and a pluggable module. The pluggable module has a pluggable body holding a module circuit board at a mating end of the pluggable module. The receptacle assembly includes a cabled receptacle connector and a receptacle cage receiving the cabled receptacle connector and the pluggable module. The receptacle cage includes a plurality of walls defining a module channel extending between a front and a rear of the receptacle cage. The plurality of walls includes a top wall, a first side wall extending from the top wall to a bottom of the receptacle cage and a second side wall extending from the top wall to the bottom. The module channel is open at the front to receive a pluggable module therein and open at the rear to receive the cabled receptacle connector. The receptacle cage has a latching guide at the rear including a latching feature. The cabled receptacle connector is received in the module channel at the rear of the receptacle cage. The cabled receptacle connector includes a cable assembly including a frame holding contacts terminated to cables of the cable assembly and having mating ends configured to be mated with the pluggable module. The cabled receptacle connector includes a receptacle housing having a cavity extending between a front and a rear of the receptacle housing. The receptacle housing has a mating slot at the front. The cavity receives the cable assembly with the contacts positioned in the mating slot for mating engagement with the pluggable module. The receptacle housing includes a latch mount and a cover removably coupled to the latch mount and a securing plate coupled to the latch mount and the cover to secure the cover to the latch mount. The cabled receptacle connector includes a latch coupled to the receptacle housing having a latching tab latchably coupled to the latching feature of the latching guide to secure the cabled receptacle connector in the receptacle cage. The cabled receptacle connector includes a biasing spring having a first end coupled to the latch and a second end coupled to the receptacle housing. The biasing spring forward biases the receptacle housing in the receptacle cage when the latching tab is latchably coupled to the latching feature.

DETAILED DESCRIPTION OF THE INVENTION

Various embodiments described herein include a receptacle cage for a receptacle assembly of a communication system, such as for an input/output (I/O) module. The receptacle cage may be configured for a quad small form-factor pluggable (QSFP), a small form-factor pluggable (SFP), an octal small form-factor pluggable (OSFP), and the like. In various embodiments, the receptacle cage includes an opening positioned at a rear of the receptacle cage to allow for a direct-attached, cabled receptacle connector to be loaded therein at the rear and an opening positioned at a front of the receptacle cage to receive a pluggable module for mating with the corresponding cabled receptacle connector. The cabled receptacle connector is mounted directly to the receptacle cage. The cabled receptacle connectors in the receptacle cage are configured to be coupled directly to another component via the cable rather than being terminated to a host circuit board, as is common with conventional receptacle assemblies, which improves signal loss and improves skew by transmitting the signals via cables versus standard, board mounted receptacle connectors. In various embodiments, the receptacle assembly may be utilized without a host circuit board altogether, such as by mounting the receptacle cage to another component other than a circuit board.

Figure 1:
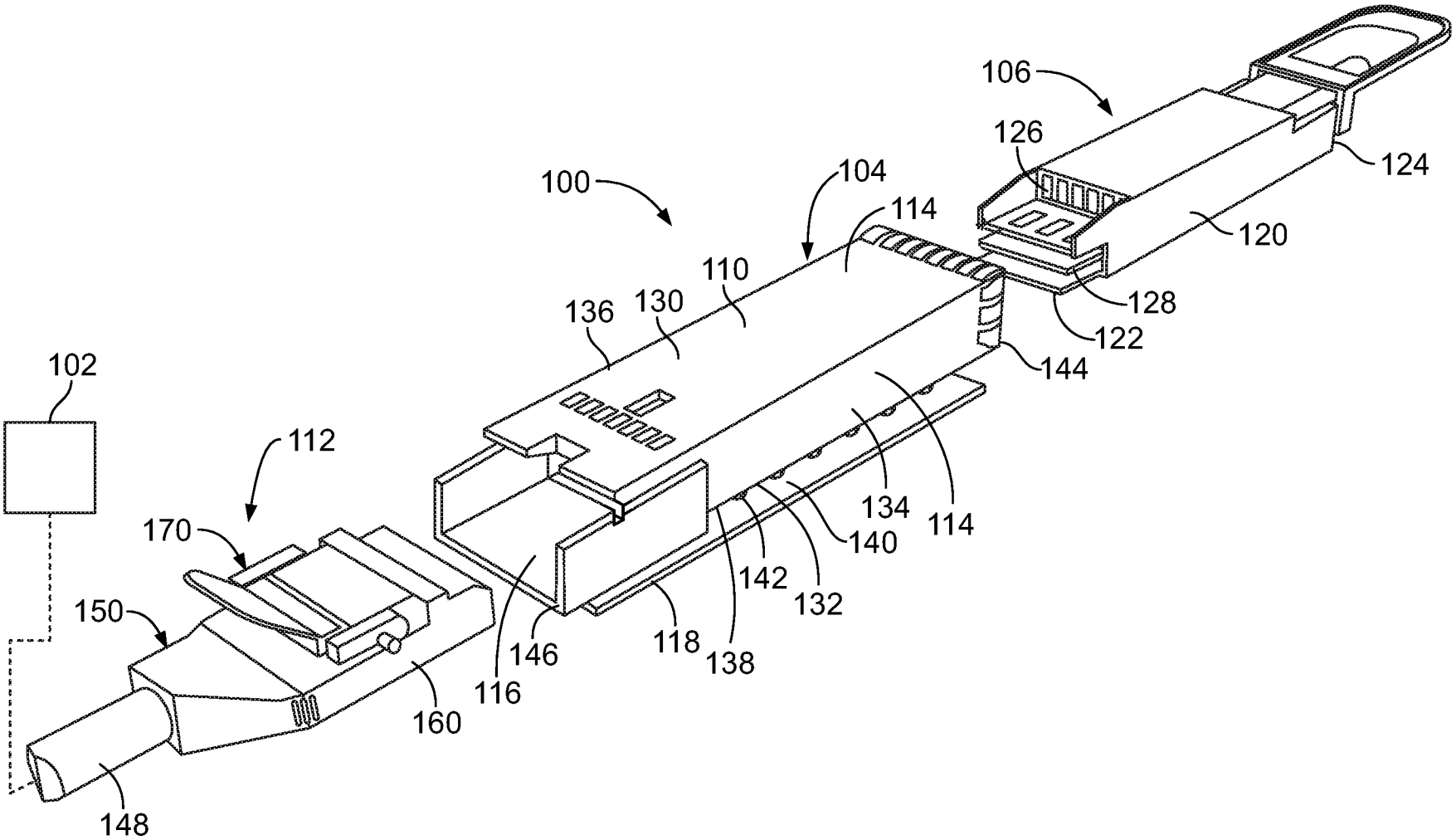
FIG. 1 is an exploded view of a communication system formed in accordance with an exemplary embodiment.
Figure 2:
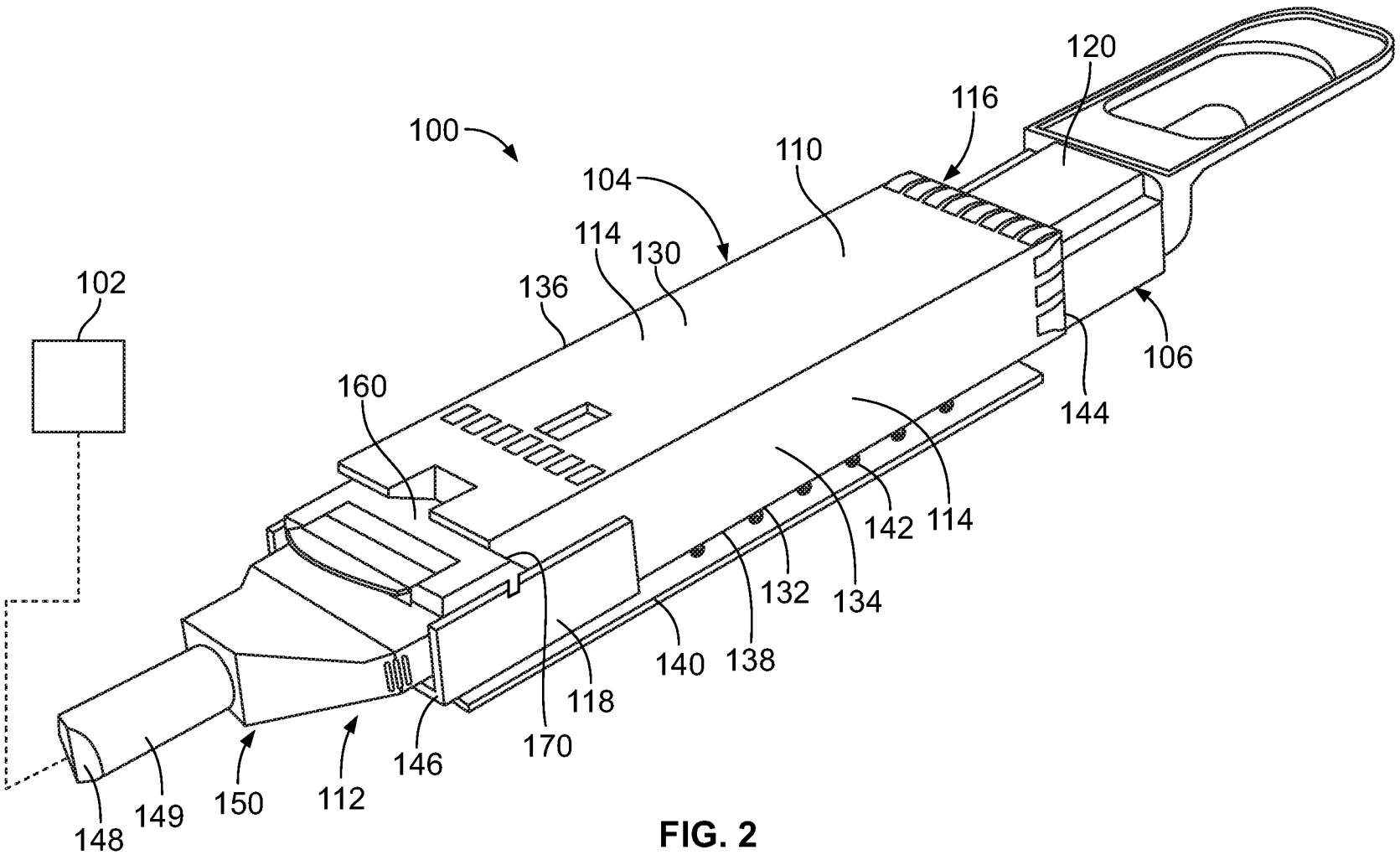
FIG. 2 is a rear perspective view of the communication system in accordance with an exemplary embodiment in an assembled state.

FIG. 1 is an exploded view of a communication system 100 formed in accordance with an exemplary embodiment. FIG. 2 is a rear perspective view of the communication system 100 in an assembled state. The communication system 100 includes an electrical component 102 and a receptacle assembly 104 electrically connected to the electrical component 102. The electrical component 102 may be located remote from the receptacle assembly 104, such as behind the receptacle assembly 104. The receptacle assembly 104 is electrically connected to the electrical component 102 via cables. A pluggable module 106 is configured to be electrically connected to the receptacle assembly 104. The pluggable module 106 is electrically connected to the electrical component 102 through the receptacle assembly 104. For example, the signals of the receptacle assembly 104 may be electrically connected to the electrical component 102 via cables rather than conductive traces of a circuit board. In various embodiments, the receptacle assembly 104 may be mated with a plurality of pluggable modules 106 rather than a single pluggable module 106.

In an exemplary embodiment, the receptacle assembly 104 includes a receptacle cage 110 and a cabled receptacle connector 112 received in the receptacle cage 110 for mating with the corresponding pluggable module 106. Optionally, a portion of the cabled receptacle connector 112 may extend from or be located rearward of the receptacle cage 110. In various embodiments, the receptacle assembly 104 may include a plurality of cabled receptacle connectors 112 within the receptacle cage 110 rather than a single cabled receptacle connector 112.

In various embodiments, the receptacle cage 110 is enclosed and provides electrical shielding for the cabled receptacle connector 112. The pluggable module 106 is loaded into the front of the receptacle cage 110 and is at least partially surrounded by the receptacle cage 110. In an exemplary embodiment, the receptacle cage 110 includes a shielding, stamped and formed cage member that includes a plurality of shielding walls 114 that define a module channel 116 that receives the pluggable module 106 and the cabled receptacle connector 112. In an exemplary embodiment, the receptacle cage 110 includes a latching guide 118 for securing the cabled receptacle connector 112 in the receptacle cage 110. In various embodiments, the latching guide 118 is separate and discrete from the shielding walls 114 defining the cage member and coupled thereto, such as at a rear of the receptacle cage 110. The latching guide 118 may be separately mounted to the host circuit board. The latching guide 118 may be manufactured from a different material than the shielding walls 114, such as a plastic material. For example, the latching guide 118 may be molded to form the features of the latching guide 118, such as the guide features, the latching features, the support features, and the like. In other various embodiments, the latching guide 118 may be integral with the cage member, such as being defined by the shielding walls 114.

In other embodiments, the receptacle cage 110 may be open between frame members to provide cooling airflow for the pluggable module 106 and the cabled receptacle connector 112 with the frame members of the receptacle cage 110 defining guide tracks for guiding loading of the pluggable modules 106 into the receptacle cage 110. In other various embodiments, the receptacle cage 110 may constitute a stacked cage member and/or a ganged cage member having a plurality of module channels 116 stacked and/or ganged vertically or horizontally.

As shown in FIG. 1, the pluggable module 106 has a pluggable body 120, which may be defined by one or more shells. The pluggable body may be thermally conductive and/or may be electrically conductive, such as to provide EMI shielding for the pluggable module 106. The pluggable body 120 includes a mating end 122 and an opposite front end 124. The mating end 122 is configured to be inserted into the module channel. The front end 124 may be a cable end having a cable extending therefrom to another component within the system.

The pluggable module 106 includes a module circuit board 128 that is configured to be communicatively coupled to the cabled receptacle connector 112. The module circuit board 128 may be accessible at the mating end 122. The module circuit board 128 may include components, circuits and the like used for operating and or using the pluggable module 106. For example, the module circuit board 128 may have conductors, traces, pads, electronics, sensors, controllers, switches, inputs, outputs, and the like associated with the module circuit board 128, which may be mounted to the module circuit board 128, to form various circuits.

The pluggable module 106 includes an outer perimeter defining an exterior of the pluggable body 120. The exterior extends between the mating end 122 and the front end 124 of the pluggable module 106. In an exemplary embodiment, the pluggable body 120 provides heat transfer for the module circuit board 128, such as for the electronic components on the module circuit board 128. For example, the module circuit board 128 is in thermal communication with the pluggable body 120 and the pluggable body 120 transfers heat from the module circuit board 128. In an exemplary embodiment, the pluggable body 120 includes a plurality of heat transfer fins 126 along at least a portion of the outer perimeter of the pluggable module 106. The fins 126 transfer heat away from the main shell of the pluggable body 120, and thus from the module circuit board 128 and associated components. The fins 126 are separated by gaps that allow airflow or other cooling flow along the surfaces of the fins 126 to dissipate the heat therefrom. In the illustrated embodiment, the fins 126 are parallel plates that extend lengthwise; however, the fins 126 may have other shapes in alternative embodiments, such as cylindrical or other shaped posts. The pluggable module 106 may have a top wall over the fins 126.

In an exemplary embodiment, the walls 114 of the receptacle cage 110 include a top wall 130, a bottom wall 132, a first side wall 134 and a second side wall 136. The first and second side walls 134, 136 extend from the top wall 130 to a bottom 138 of the receptacle cage 110, such as to the bottom wall 132. However, in other various embodiments, the receptacle cage 110 is provided without the bottom wall 132 and the side walls 134, 136 may be mounted to a component 140, such as a chassis, substrate or circuit board. In various embodiments, the bottom wall 132 may rest on the component 140, such as a chassis, substrate or circuit board. Optionally, the walls 114 may include mounting features 142, such as compliant pins, used to mount the receptacle cage 110 to the component 140.

In an exemplary embodiment, the receptacle cage 110 may include one or more gaskets at a front 144 of the receptacle cage 110. For example, the gaskets may be configured to electrically connect with the pluggable module 106 and/or a bezel or other panel at the front 144. For example, the receptacle cage 110 may be received in a bezel opening of a bezel and the gasket may electrically connect to the bezel within the bezel opening.

In an exemplary embodiment, the receptacle assembly 104 may include one or more heat sinks (not shown) for dissipating heat from the pluggable module 106. For example, the heat sink may be coupled to the top wall 130 for engaging the pluggable module 106. The heat sink may extend through an opening in the top wall 130 to directly engage the pluggable module 106. Other types of heat sinks may be provided in alternative embodiments.

In an exemplary embodiment, the cabled receptacle connector 112 is received in the receptacle cage 110, such as at a rear 146 of the receptacle cage 110. The rear 146 is open to receive the cabled receptacle connector 112. The cabled receptacle connector 112 is positioned in the module channel 116 to interface with the pluggable module 106 when loaded therein. In an exemplary embodiment, the cabled receptacle connector 112 is latchably coupled to the receptacle cage 110, such as to the latching guide 118 of the receptacle cage 110. The pluggable module 106 is loaded through the front 144 to mate with the cabled receptacle connector 112. The shielding walls 114 of the receptacle cage 110 provide electrical shielding around the cabled receptacle connector 112 and the pluggable modules 106, such as around the mating interfaces between the cabled receptacle connector 112 and the pluggable modules 106. The cabled receptacle connector 112 is electrically connected to the electrical component 102 via cables 148 extending rearward from the cabled receptacle connector 112. The cables 148 are routed to the electrical component 102, such as behind the receptacle cage 110.

The cabled receptacle connector 112 includes a cable assembly 150 including the cables 148 and contacts 152 (shown in FIG. 3) terminated to the cables 148. The cabled receptacle connector 112 includes a receptacle housing 160 that receives the cable assembly 150. The cabled receptacle connector 112 includes a latch 170 coupled to the receptacle housing 160. The latch 170 is configured to be coupled to the latching guide 118 to secure the cabled receptacle connector 112 to the receptacle cage 110.

In an exemplary embodiment, the latching guide 118 is coupled to the rear 146 of the shielding walls 114. The latching guide 118 extends rearward of the shielding walls 114. Optionally, the mounting features 142 may be used to secure the latching guide 118 to the shielding walls 114. Other securing features may be used to secure the latching guide 118 to the shielding walls 114, such as clips, fasteners, solder, and the like. The mounting features 142 are used to secure the receptacle cage 110 to the component 140. For example, the mounting features 142 may be press fit into vias in the component 140. In other various embodiments, the mounting features 142 may be soldered to the component 140. In alternative embodiments, separate mounting features 142, such as clips, fasteners, and the like, may be used to secure the receptacle cage 110 to the component 140.

In an exemplary embodiment, the latching guide 118 includes a latching feature 210 for securing the cabled receptacle connector 112 to the receptacle cage 110. The latching feature 210 is accessible from behind the receptacle cage 110. For example, the cabled receptacle connector 112 is configured to interface with the latching feature 210 as the cabled receptacle connector 112 is plugged into the receptacle cage 110. In an exemplary embodiment, the latching guide 118 includes latching features 210 at both sides of the latching guide 118.

In an exemplary embodiment, the latching feature 210 includes a latch pocket 212 for receiving the latch 170 (FIG.

1) of the cabled receptacle connector 112. Optionally, the latch pocket 212 may be open from above the latch pocket 212 for receiving the latch 170. In an exemplary embodiment, the latching feature 210 includes a catch surface 214 for securing the latch 170 in the latch pocket 212. Optionally, the catch surface 214 may be rearward of the latch pocket 212. The catch surface 214 may be shaped to retain the latch 170 in the latch pocket 212 to hold the latch 170 in the receptacle cage 110. For example, the catch surface 214 blocks rearward removal of the cabled receptacle connector 112 from the receptacle cage 110. The catch surface 214 may extend partially over a top of the latch pocket 212 to make removal of the latch from the latch pocket 212 more difficult, such as to prevent inadvertent removal of the latch 170 from the latch pocket 212. The latch 170 is removed from the latch pocket 212 by lifting the latch 170 and/or the cabled receptacle connector 112 upward to clear the catch surface 214.

Figure 3:
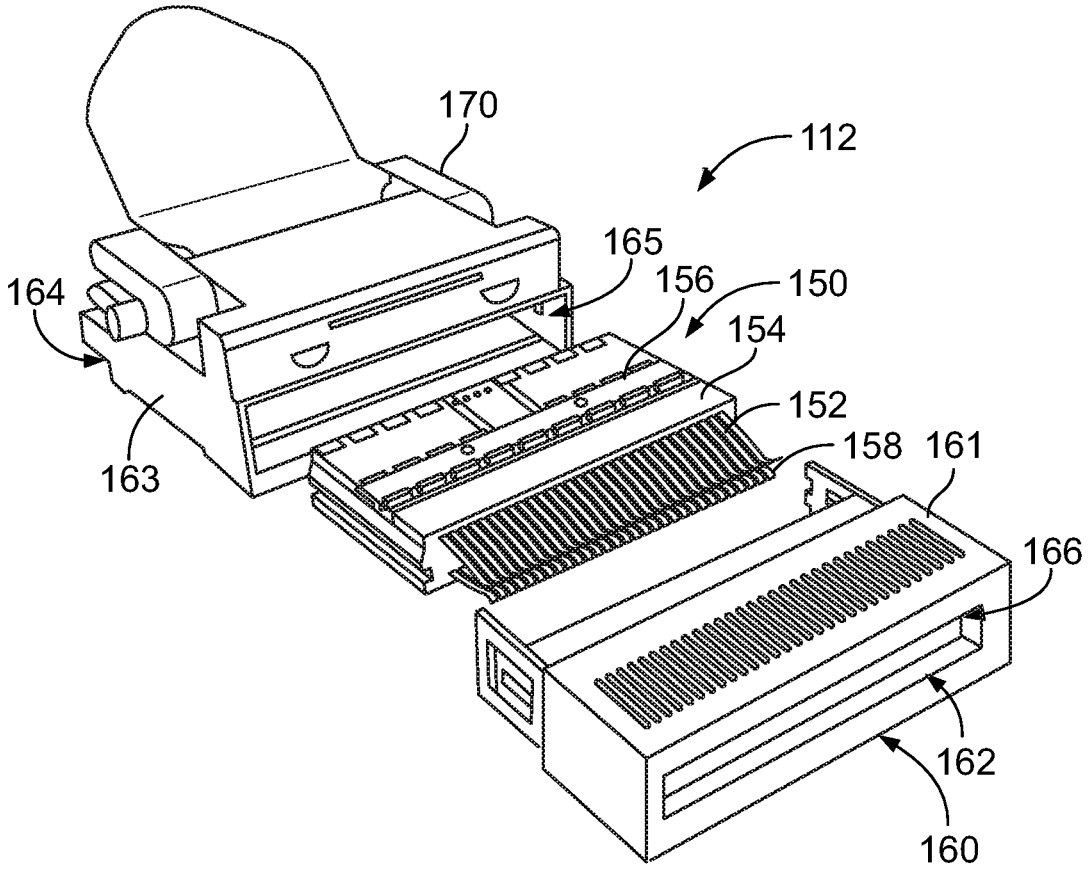
FIG. 3 is an exploded view of a cabled receptacle connector of the communication system in accordance with an exemplary embodiment.

FIG. 3 is an exploded view of the cabled receptacle connector 112 in accordance with an exemplary embodiment. The cabled receptacle connector 112 includes the receptacle housing 160 having the latch 170 coupled thereto. The receptacle housing 160 extends between a mating end 162 and a cable end 164. Optionally, the receptacle housing 160 may be a multi-piece housing, such as including a front housing 161 at the mating end 162 and a main housing body 163 at the cable end 164. In alternative embodiments, the receptacle housing 160 may be a single-piece housing. The receptacle housing 160 has a cavity 165 extending between the mating end 162 and the cable end 164. The cavity 165 receives the cable assembly 150. The housing 160 holds the contacts 152 of the cable assembly 150 in a mating slot 166 at a front of the housing 160. The mating slot 166 forms part of the cavity 165, such as the front end of the cavity 165. The mating slot 166 is configured to receive part of the pluggable module 106 (FIG. 1), such as the module circuit board 128 (FIG. 1). The contacts 152 are configured to be positioned in the mating slot 166 for interfacing with the module circuit board 128.

The cable assembly 150 includes a frame 154 holding the contacts 152. The frame 154 is configured to be loaded into the cavity 165, such as through the mating end 162 or the cable end 164. Optionally, the frame 154 may hold the contacts 152 in an upper row and a lower row. The contacts 152 may include ground contacts and signal contacts. For example, the contacts 152 may arrange the signal contacts in pairs with the pairs separated by corresponding ground contacts. The frame 154 may be overmolded over the contacts 152. For example, the contacts 152 may be part of a leadframe being overmolded to form the frame 154. In an exemplary embodiment, the cable assembly 150 includes a ground bus bar 156 coupled to ground contacts of the contacts 152. In an exemplary embodiment, each contact 152 includes a mating end 158. The mating ends 158 may be cantilevered beams. The contacts 152 are electrically connected to the cables 148, such as at terminating ends (not shown) opposite the mating ends 158. For example, the contacts 152 may be soldered to corresponding cables 148. The frame 154 may hold the cables 148. For example, the frame 154 may be overmolded over ends of the cables 148 to provide strain relief for the cables 148.

Figure 4:
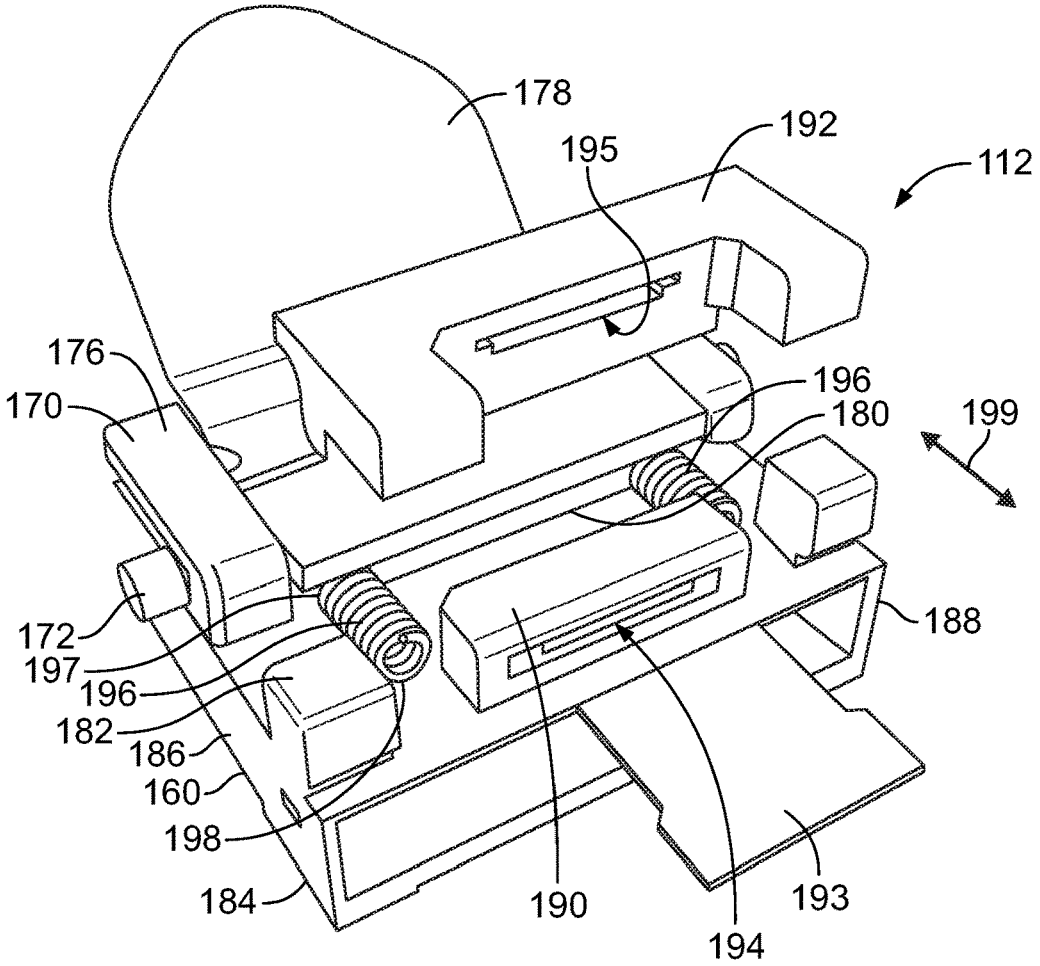
FIG. 4 is an exploded view of a portion of the cabled receptacle connector in accordance with an exemplary embodiment.

FIG. 4 is an exploded view of a portion of the cabled receptacle connector 112 in accordance with an exemplary embodiment. The latch 170 is coupled to the receptacle housing 160. In an exemplary embodiment, the latch 170 is rotatably coupled to the receptacle housing 160. The latch 170 includes a latching tab 172 having a latching surface 174. The latching tab 172 is configured to be received in the latch pocket 212 (FIG. 2). Optionally, the latch 170 may include latching tabs 172 on both sides of the latch 170. In the illustrated embodiment, the latching tabs 172 are posts or ribs extending from the opposite sides of the latch 170. Other types of latching tabs 172 may be used in alternative embodiments.

The latch 170 includes a handle 176 at a rear of the latch 170. Optionally, a tether 178 may extend from the handle 176. The tether 178 may be pulled, such as to rotate the latch 170. In an exemplary embodiment, the latch 170 includes a pivot axle 180 extending between opposite sides of the handle 176. The pivot axle 180 may be located at a front of the latch 170. Optionally, the pivot axle 180 may be offset from the latching tabs 172 such that rotation of the latch 170 about the pivot axle 180 causes the latching tabs 172 to move vertically relative to the receptacle housing 160, such as for insertion and removal into and out of the latch pocket 212.

In an exemplary embodiment, the receptacle housing 160 includes a top 182 and a bottom 184. The receptacle housing 160 includes a first side 186 and a second side 188 extending between the top 182 and the bottom 184. The latch 170 is coupled to the top 182. In an exemplary embodiment, the receptacle housing 160 includes a latch mount 190 at the top 182. The latch 170 is coupled to the latch mount 190. In an exemplary embodiment, the receptacle housing 160 includes a cover 192 coupled to the top 182. For example, the cover 192 may be coupled to the latch mount 190. The cover 192 is used to hold the latch 170 in the latch mount 190. In an exemplary embodiment, a latch plate 193 is used to couple the cover 192 to the latch mount 190. For example, the latch plate 193 is received in slots 194, 195 in the latch mount 190 and the cover 192, respectively.

In an exemplary embodiment, cabled receptacle connector 112 includes biasing springs 196 coupled between the latch 170 and the receptacle housing 160. For example, a first end 197 of each biasing spring 196 is coupled to the latch 170 and a second end 198 of each biasing spring 196 is coupled to the cover 192. The biasing springs 196 are compressed between the latch 170 and the cover 192. The biasing springs 196 forward bias the receptacle housing 160 relative to the latch 170 in a forward biasing direction 199. For example, when the latching tabs 172 of the latch 170 are captured in the latch pockets 212, the biasing springs 196 forward bias the receptacle housing 160. Optionally, the first ends 197 of the biasing springs 196 may be coupled to the pivot axle 180.

Figure 5:
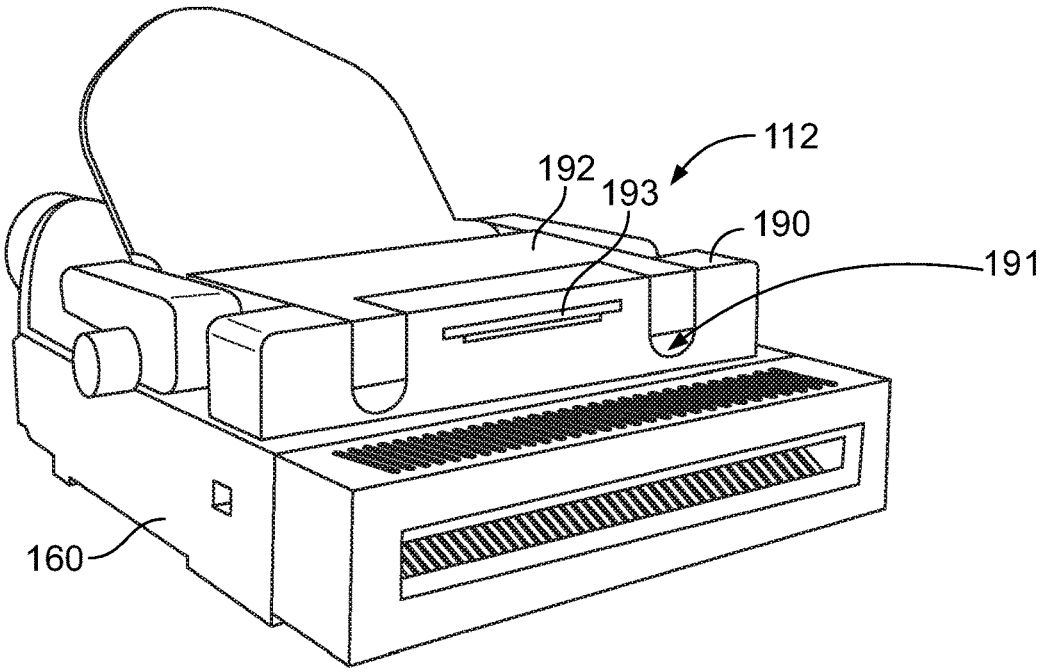
FIG. 5 is a front perspective view of the cabled receptacle connector in an assembled state in accordance with an exemplary embodiment.

FIG. 5 is a front perspective view of the cabled receptacle connector 112 in an assembled state. The cover 192 is coupled to the receptacle housing 160. Optionally, access openings 191 are provided at the front for accessing the biasing springs 196 (FIG. 4). For example, a tool may pass through the access openings 191 to compress the biasing springs 196 to allow the cover 192 to be loaded into position on the receptacle housing 160, such as relative to the latch mount 190. The latch plate 193 secures the cover 192 to the latch mount 190 to capture the biasing springs 196 between the cover 192 and the pivot axle 180 (FIG. 4).

Figure 6:
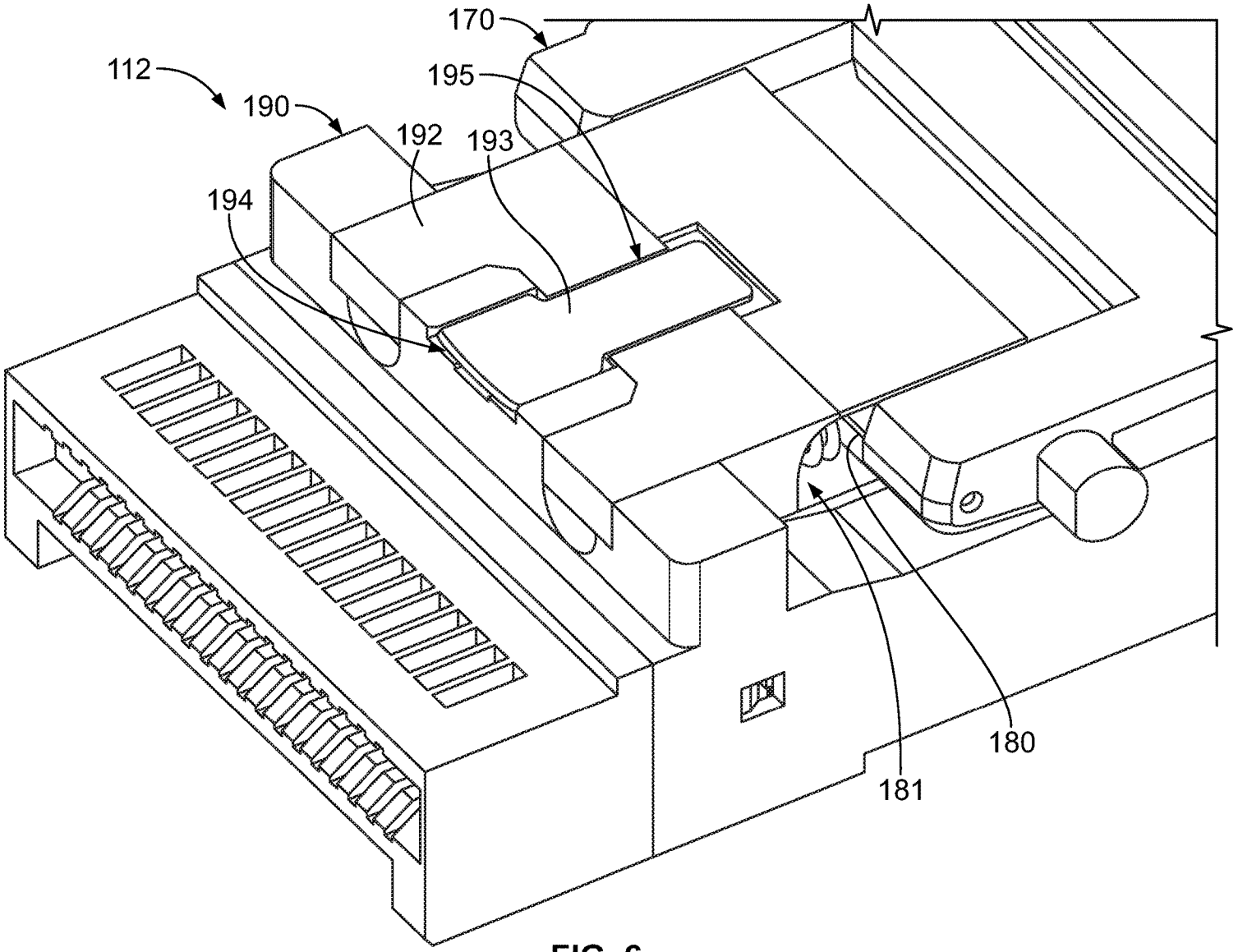
FIG. 6 is a top perspective, partial sectional view of the cabled receptacle connector in accordance with an exemplary embodiment.
Figure 7:
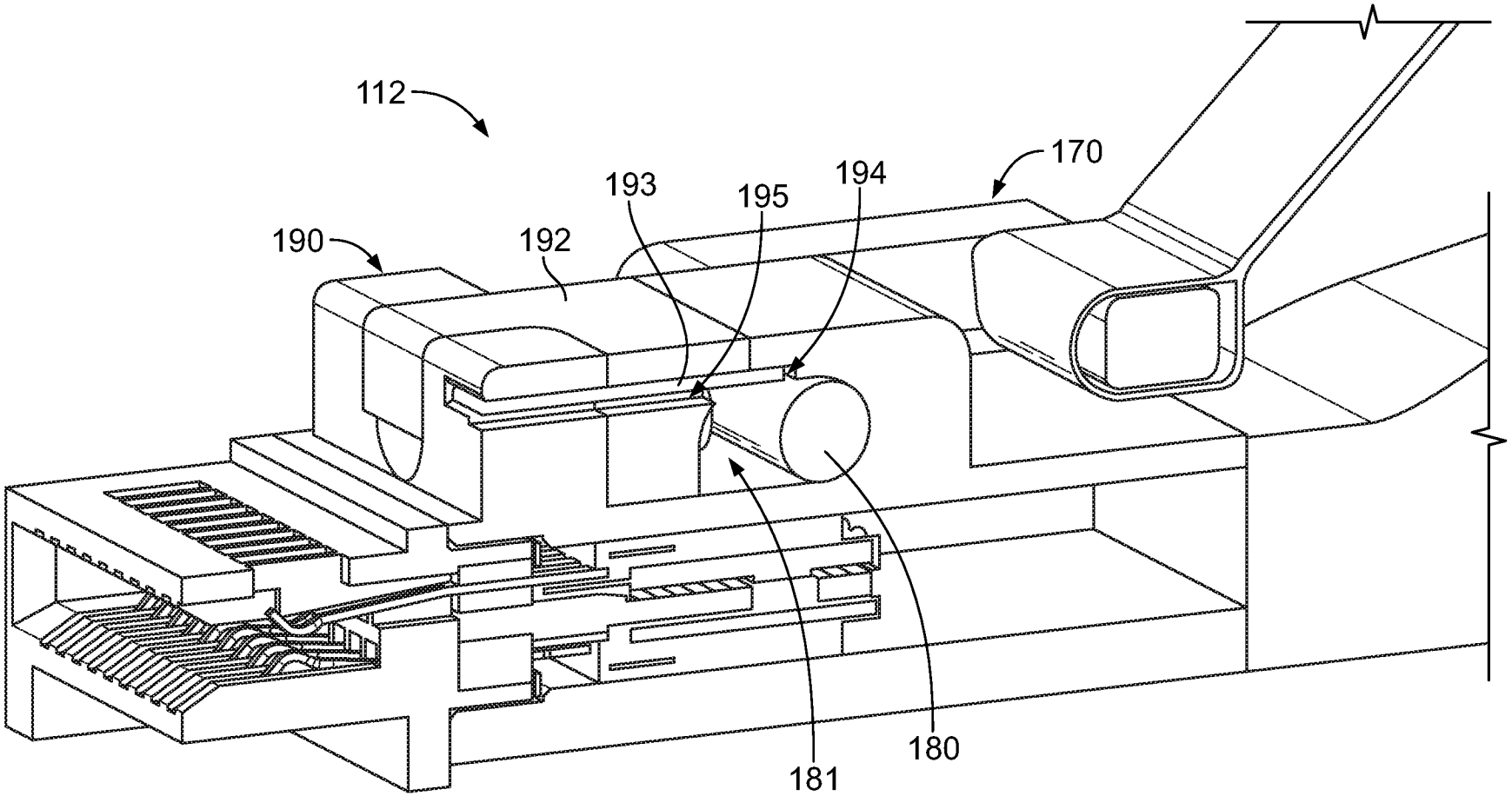
FIG. 7 is a side perspective, partial sectional view of the cabled receptacle connector in accordance with an exemplary embodiment.

FIG. 6 is a top perspective, partial sectional view of the cabled receptacle connector 112 in accordance with an exemplary embodiment. FIG. 7 is a side perspective, partial sectional view of the cabled receptacle connector 112 in accordance with an exemplary embodiment. FIGS. 6 and 7 illustrate the latch 170 coupled to the latch mount 190. The pivot axle 180 is received in a slot 181 in the latch mount 190. The pivot axle 180 is rotatable within the slot 181. The pivot axle 180 is slidable within the slot 181, such as forward and rearward. FIGS. 6 and 7 illustrate the latch plate 193 coupled to the cover 192 and coupled to the latch mount 190 to secure the cover 192 to the latch mount 190. The latch plate 193 is received in slot 194 in the latch mount 190 and in the slot 195 in the cover 192.

Figure 8:
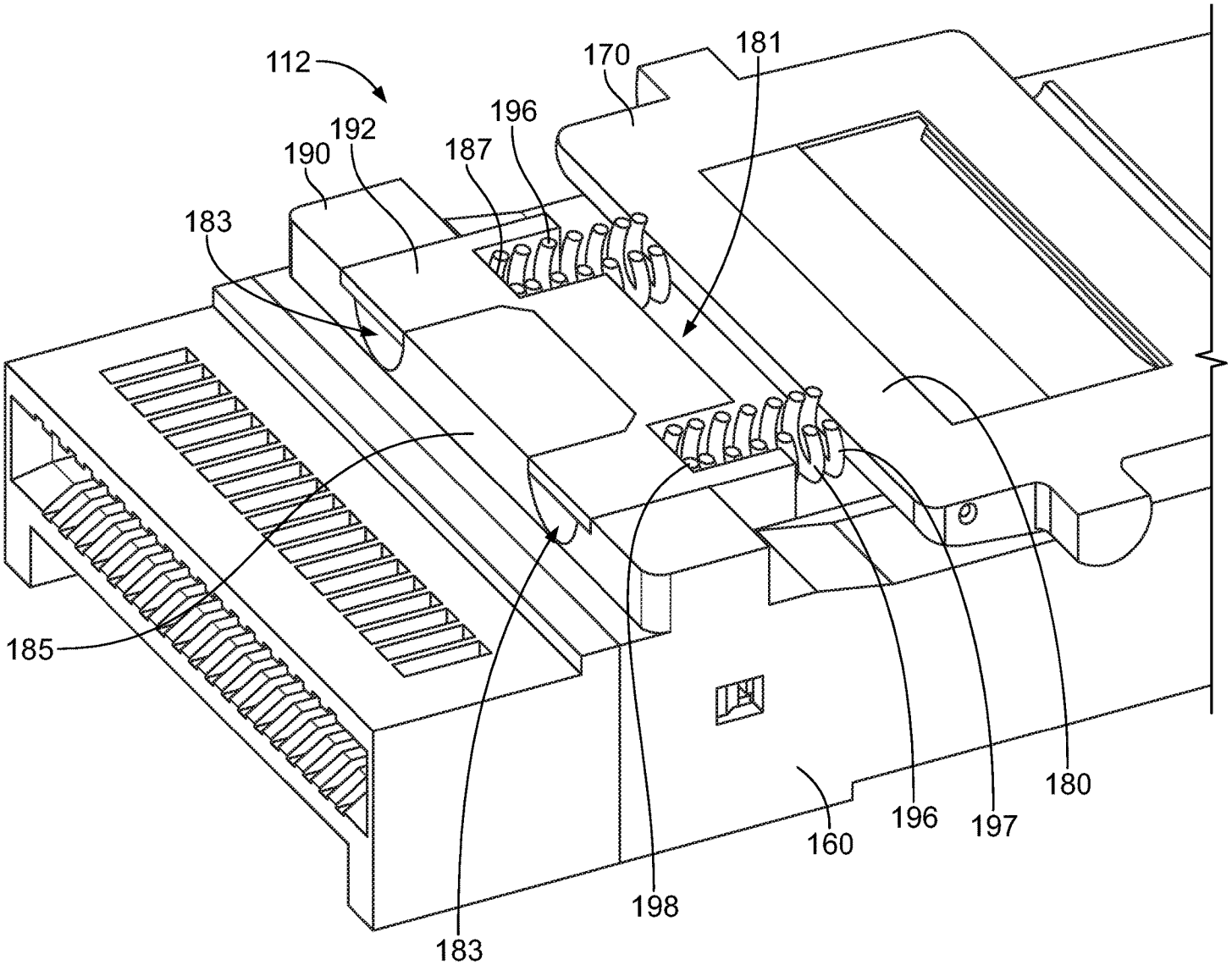
FIG. 8 is a top perspective, partial sectional view of the cabled receptacle connector in accordance with an exemplary embodiment.
Figure 9:
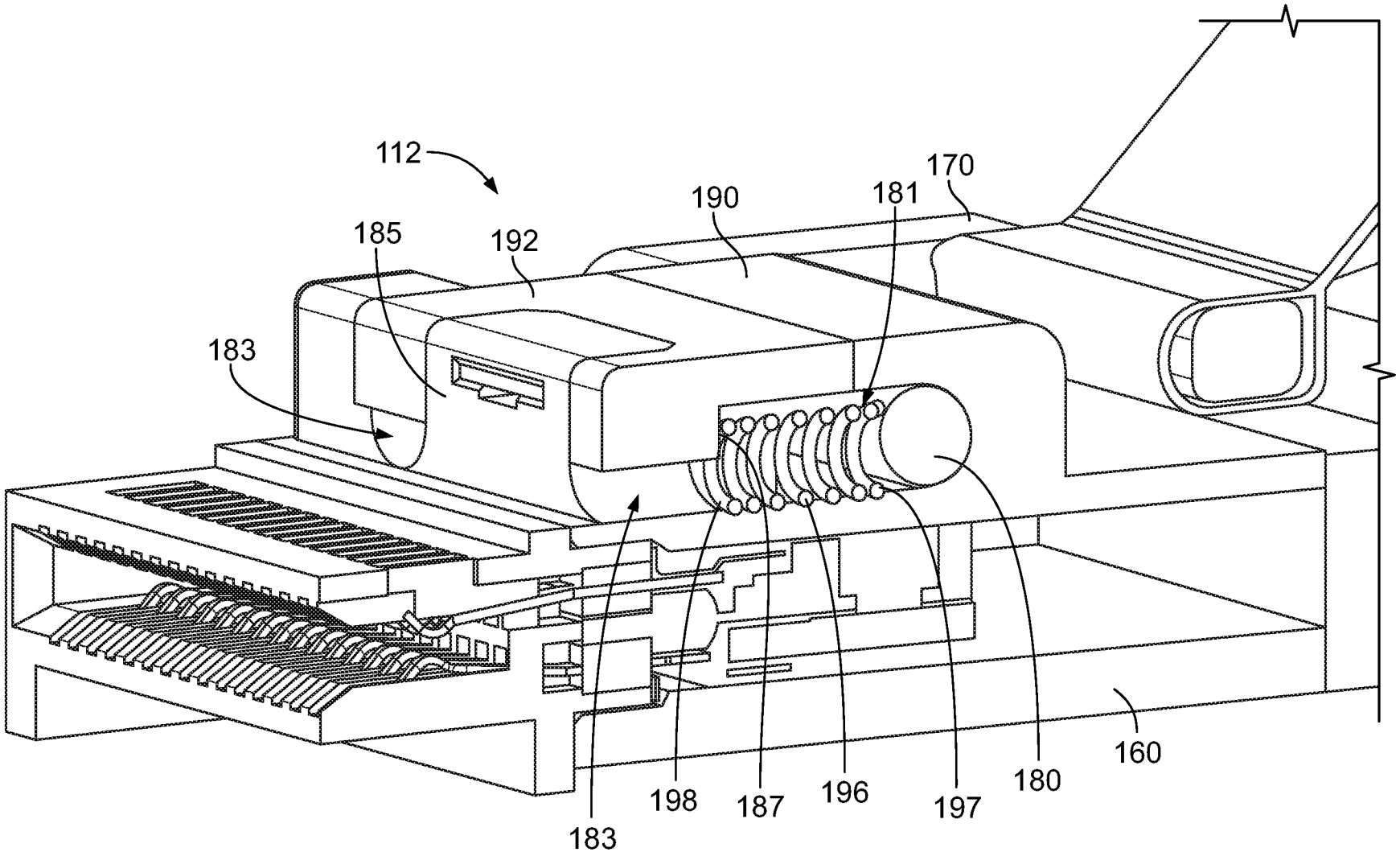
FIG. 9 is a side perspective, partial sectional view of the cabled receptacle connector in accordance with an exemplary embodiment.

FIG. 8 is a top perspective, partial sectional view of the cabled receptacle connector 112 in accordance with an exemplary embodiment. FIG. 9 is a side perspective, partial sectional view of the cabled receptacle connector 112 in accordance with an exemplary embodiment. FIGS. 8 and 9 illustrate the biasing springs 196 interfacing with the cover 192 and the latch 170. The first end 197 of each biasing spring 196 presses against the pivot axle 180 of the latch 170 and the second end 198 of each biasing spring 196 presses against the cover 192. The biasing springs 196 are compressed between the latch 170 and the cover 192.

In an exemplary embodiment, the receptacle housing 160 includes access ports 183 in a front wall 185 of the latch mount 190. The access ports 183 extend through the front wall 185 to the slot 181. The access ports 183 are aligned with the biasing springs 196 and provide access for the assembler to compress the biasing springs 196 during assembly. For example, the assembler may insert a tool into the access ports 183 to compress the biasing springs 196 in a rearward direction. The biasing springs 196 are compressed rearward away from the front wall 185 to provide a clearance space for lowering the cover 192 onto the receptacle housing 160. For example, the biasing springs 196 may be compressed rearward of a bearing wall 187 of the cover 192 to allow the bearing wall 187 to be positioned forward of the biasing springs 196. The latch plate 193 may be coupled to the cover 192 to secure the cover 192 in place and then the biasing springs 196 may be released to press against the bearing wall 187. Optionally, the cover 192 may include pockets at the bearing wall 187 that receive the second ends 198 of the biasing springs 196. In the illustrated embodiment, the access ports 183 are semi-circular in shape; however, the access ports 183 may have other shapes in alternative embodiments.

Figure 10:
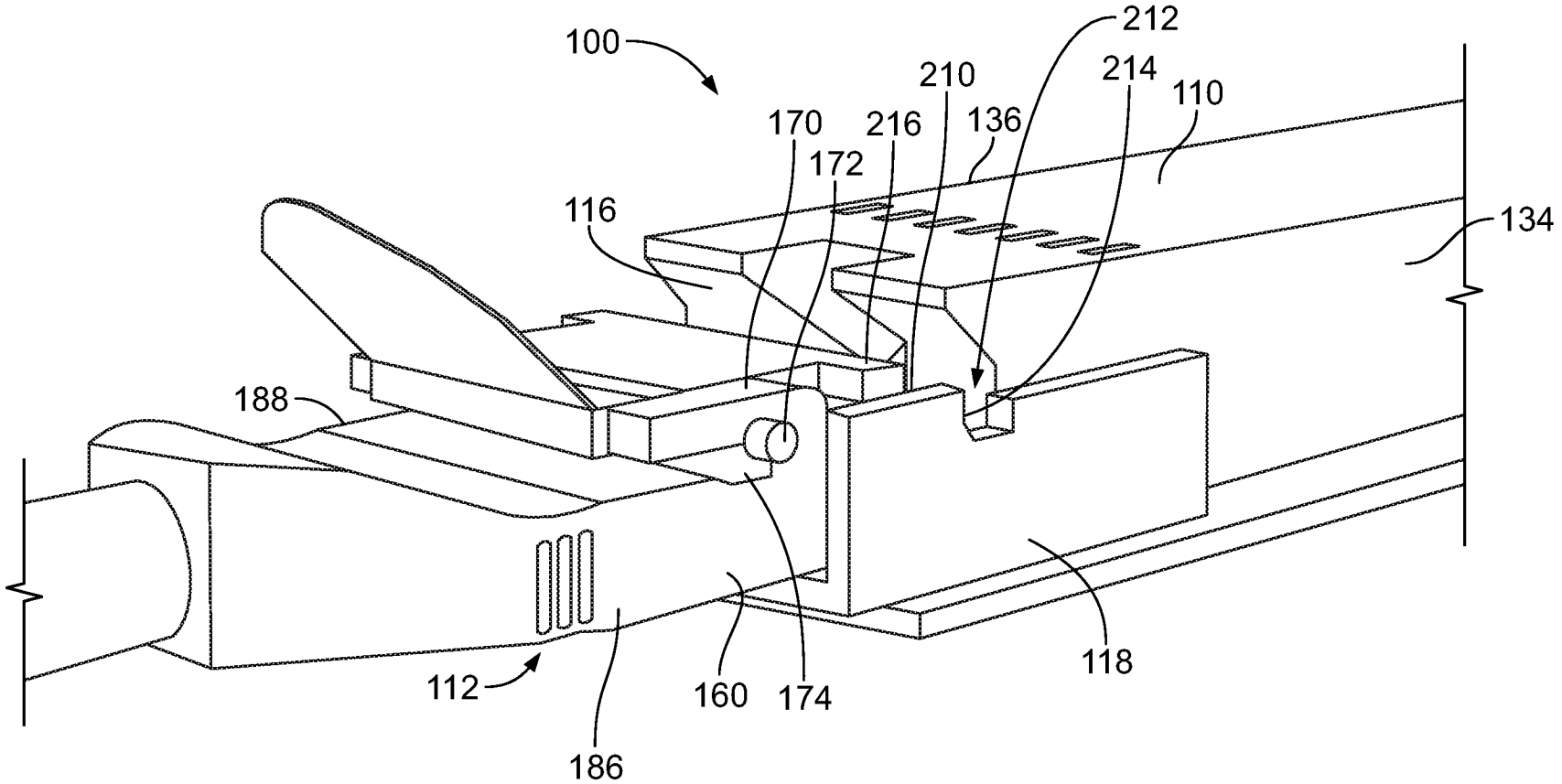
FIG. 10 is a rear perspective view of a portion of the communication system showing the cabled receptacle connector and the receptacle cage in accordance with an exemplary embodiment.

FIG. 10 is a rear perspective view of a portion of the communication system 100 showing the cabled receptacle connector 112 being loaded into the receptacle cage 110. The receptacle cage 110 includes the latching features 210. The cabled receptacle connector 112 includes the latching tabs 172 configured to engage and interface with the latching features 210 of the receptacle cage 110. The latch 170 may be rotated forward or upward to elevate the latching tabs 172 relative to the latching guide 118, such as to position the latching tabs 172 in the latching features 210. The cabled receptacle connector 112 is loaded into the module channel 116 until the latching tabs 172 clear the latching feature 210. The latching tabs 172 are received in the latch pockets 212 (FIG. 2). The latching surfaces 174 interface with the catch surfaces 214 to latchably secure the latch 170 to the latching guide 118.

In an exemplary embodiment, the latch 170 is movable relative to the receptacle housing 160. For example, the latch 170 may be movable axially relative to the receptacle housing 160. The biasing springs 196 (FIG. 4) allow relative movement between the latch 170 and the receptacle housing 160. For example, the latch 170 may be forward movable relative to the receptacle housing 160. When the latching tabs 172 are received in the latch pockets 212, the latch 170 is fixed relative to the latching guide 118 and the receptacle housing 160 is able to move relative to the latch 170 and the latching guide 118. For example, the receptacle housing 160 may be forward biased into the module channel 116 for mating with the pluggable module 106 (FIG. 1).

Figure 11:
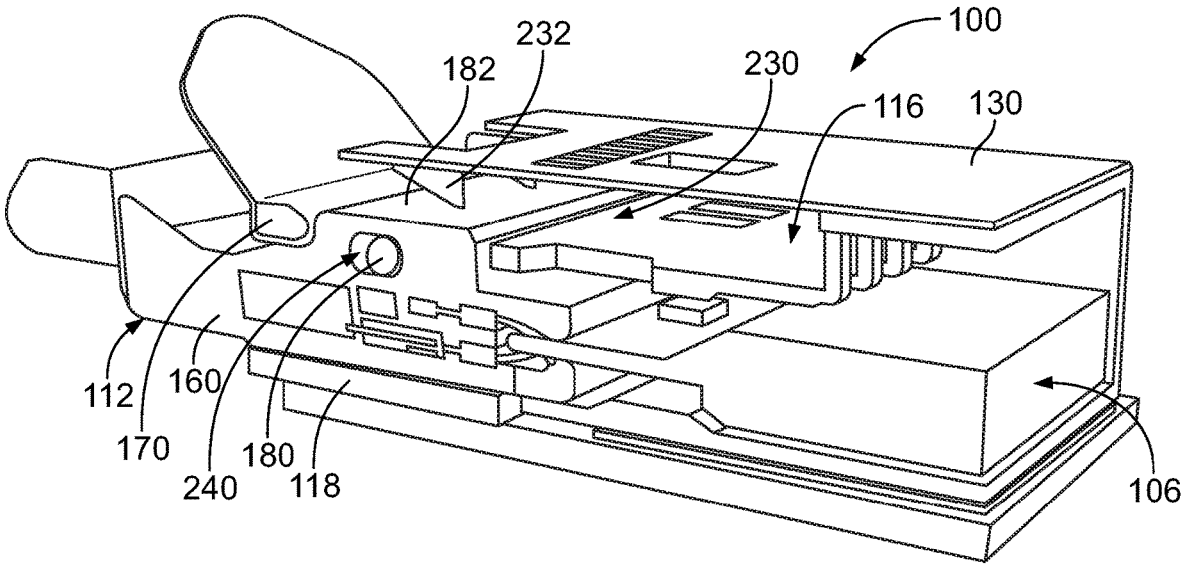
FIG. 11 is a sectional view of a portion of the communication system showing the cabled receptacle connector and a pluggable module mated with the cabled receptacle connector in accordance with an exemplary embodiment.

FIG. 11 is a sectional view of a portion of the communication system 100 showing the cabled receptacle connector 112 coupled to the receptacle cage 110 and the pluggable module 106 received in the receptacle cage 110 and mated with the cabled receptacle connector 112. In an exemplary embodiment, the receptacle cage 110 includes an airflow channel 230 along the top wall 130. The top 182 of the receptacle housing 160 is spaced apart from the top wall 130 of the receptacle cage 110. In an exemplary embodiment, the receptacle cage 110 includes positioning tabs 232 extending from the top wall 130 to engage and position the cabled receptacle connector 112 in the module channel 116. The positioning tabs 232 hold the cabled receptacle connector 112 spaced apart from the top wall 130 to form the airflow channel 230.

In an exemplary embodiment, the receptacle housing 160 includes an axle channel 240 that receives the pivot axle 180. The axle channel 240 is elongated to allow the pivot axle 180 and the receptacle housing 160 to move axially relative to each other. When the latch 170 is coupled to the latching guide 118, the latch 170 is fixed relative to the receptacle cage 110. The receptacle housing 160 is able to move relative to the latch 170 within the module channel 116. For example, the receptacle housing 160 is slidably coupled to the pivot axle 180 and is forward biased in the module channel 116 by the biasing springs 196 (FIG. 4). In an exemplary embodiment, the biasing springs 196 have a forward biasing force exceeding a rearward mating force of the pluggable module 106 with the cabled receptacle connector 112. The biasing springs 196 maintain the position of the cabled receptacle connector 112 within the module channel 116 in the forward biased position during mating of the pluggable module 106 with the cabled receptacle connector 112.

Figure 12:
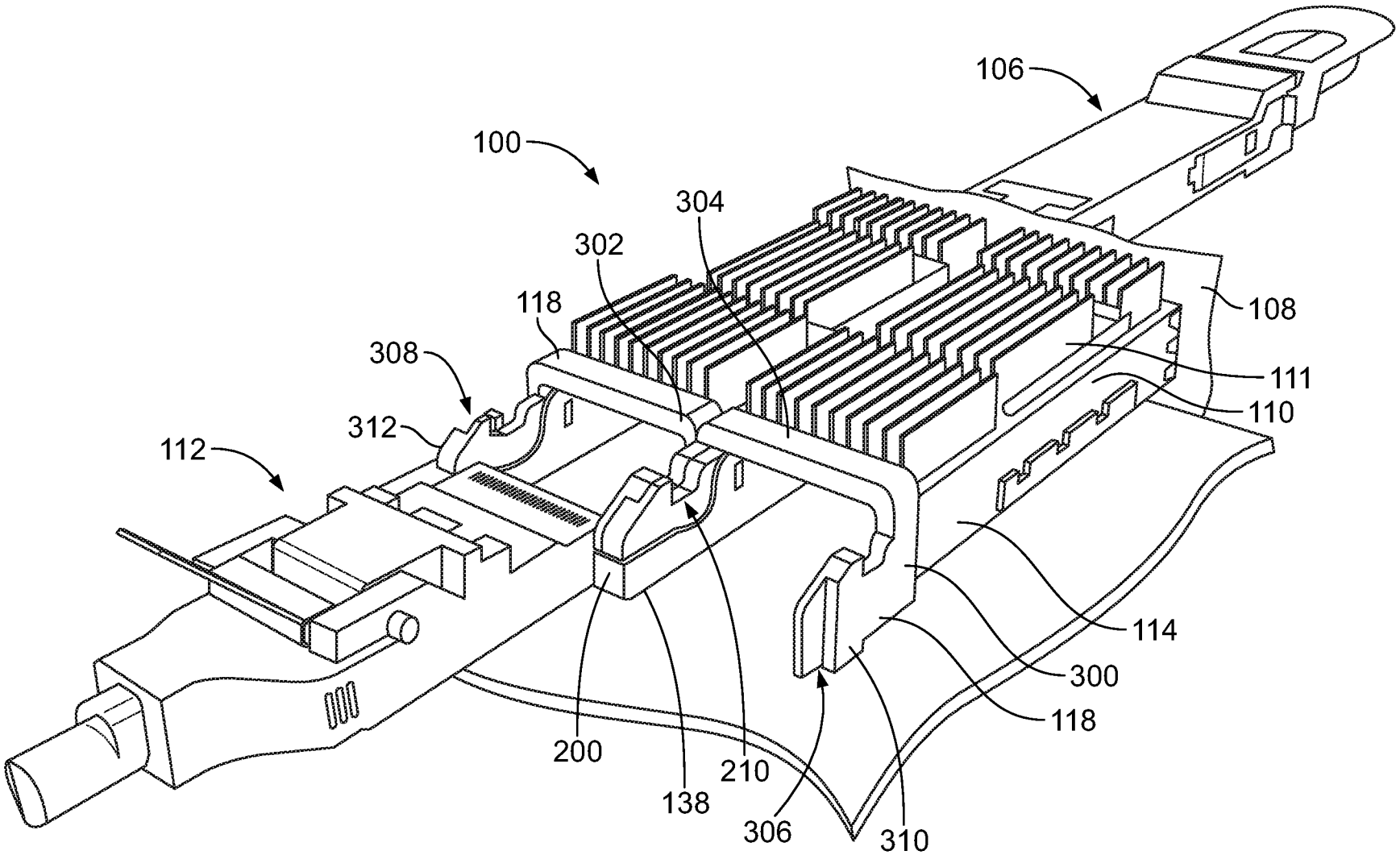
FIG. 12 is an exploded view of the communication system in accordance with an exemplary embodiment.

FIG. 12 is an exploded view of the communication system 100 in accordance with an exemplary embodiment. FIG. 12 illustrates two receptacle cages 110 stacked side-by-side and coupled to a panel 108. FIG. 12 illustrates one of the cabled receptacle connectors 112 poised for coupling to the receptacle cage 110 and the corresponding pluggable module 106 poised for loading into the receptacle cage 110 for coupling to the cabled receptacle connector 112.

FIG. 12 illustrates the receptacle cages 110 with heat sinks 111 coupled thereto. The heat sinks have heat dissipating fins. In the illustrated embodiment, the latching guides 118 are coupled to the shielding walls 114 at the rear of the receptacle cage 110. The latching guides 118 are sized and shaped differently in the embodiment illustrated in FIG. 12 compared to the embodiment illustrated in FIG. 1. Each latching guide includes a first side wall 300, a second side wall 302 and a top wall 304 between the side walls 300, 302. The latching guide 118 is open along the bottom 138. In an exemplary embodiment, the side walls 300, 302 of the latching guides 118 overlap to allow tight spacing between the receptacle cages 110. For example, the first side wall 300 includes a cutout 306 and the second side wall 302 includes a cutout 308. The cutouts 306, 308 are offset from each other. The first side wall 300 includes a mounting block 310 and the second side wall 302 includes a mounting block 312. The mounting blocks 310, 312 are offset from each other. When the latching guides 118 are stacked adjacent each other, the mounting block 310 is received in the cutout 308 of the adjacent latching guide 118 and the mounting block 312 is received in the cutout 306 of the adjacent latching guide 118. The adjacent latching guides 118 cooperate to define the latching features 210. When mounting the latching guides 118 adjacent each other, the abutting walls define a single wall structure between the receptacle cages 110. The two thin walls cooperate to form a single thicker wall that is more robust than the individual walls for supporting the cabled receptacle connectors 112 in the receptacle cages 110.

Figure 13:
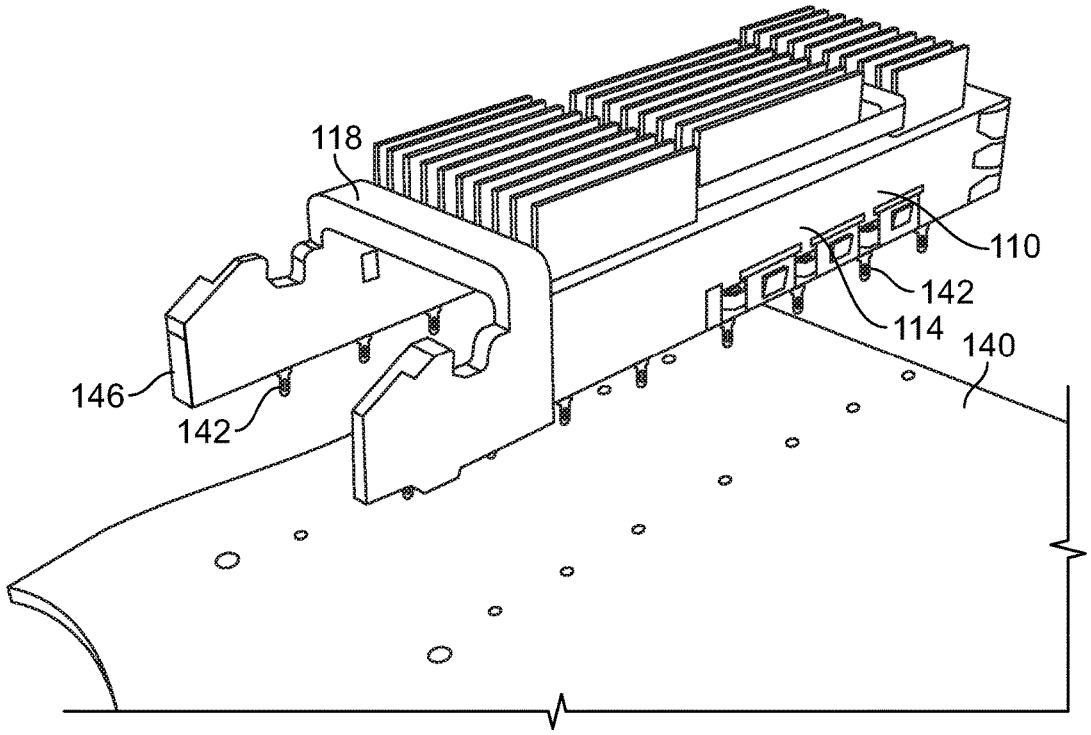
FIG. 13 is a rear perspective view of the receptacle cage poised for coupling to a component in accordance with an exemplary embodiment.

FIG. 13 is a rear perspective view of the receptacle cage 110 poised for coupling to the component 140. The latching guide 118 is coupled to the rear 146 of the shielding walls 114. The mounting features 142 are used to secure the receptacle cage 110 to the component 140. For example, the mounting features 142 may be press fit into vias in the component 140. In other various embodiments, the mounting features 142 may be soldered to the component 140. In alternative embodiments, separate mounting features 142, such as clips, fasteners, and the like, may be used to secure the receptacle cage 110 to the component 140.

Figure 14:
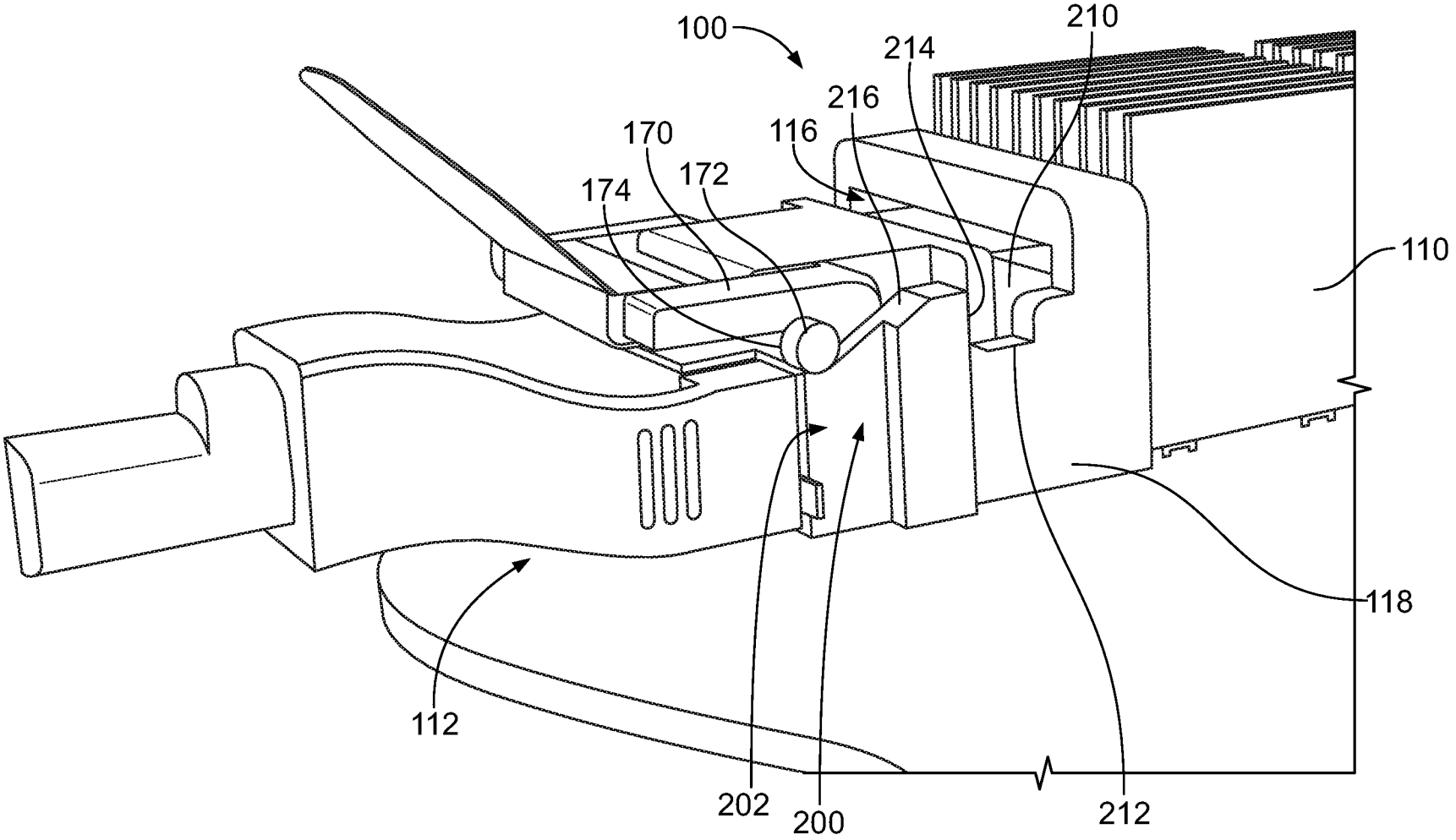
FIG. 14 is a rear perspective view of a portion of the communication system showing the cabled receptacle connector loaded into the receptacle cage in accordance with an exemplary embodiment.

FIG. 14 is a rear perspective view of a portion of the communication system 100 showing the cabled receptacle connector 112 being loaded into the receptacle cage 110. The receptacle cage 110 includes the latching features 210. The cabled receptacle connector 112 includes the latching tabs 172 configured to engage and interface with the latching features 210 of the receptacle cage 110. The cabled receptacle connector 112 is loaded into the module channel 116 until the latching tabs 172 clear the latching feature 210. The latching tabs 172 are received in the latch pockets 212. The latching surfaces 174 interface with the catch surfaces 214 to latchably secure the latch 170 to the latching guide 118.

It is understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cabled receptacle connector for a receptacle assembly comprising:

a cable assembly including a frame holding contacts, the contacts being terminated to cables of the cable assembly;

a receptacle housing having a cavity extending between a front and a rear of the receptacle housing, the receptacle housing having a mating slot at the front, the cavity receiving the cable assembly with the contacts positioned in the mating slot for mating engagement with a pluggable module removably received in a receptacle cage of the receptacle assembly, the receptacle housing including a latch mount and a cover removably coupled to the latch mount, the receptacle housing including a latch plate coupled to the latch mount and the cover to secure the cover to the latch mount;

a latch coupled to the receptacle housing, the latch having a latching tab configured to be latchably coupled to the receptacle cage; and a biasing spring having a first end coupled to the latch and a second end coupled to the cover of the receptacle housing, the biasing spring forward biasing the receptacle housing in the receptacle cage when the latching tab is latchably coupled to the receptacle cage;

wherein the cover includes access ports in the latch mount aligned with the biasing springs, the access ports providing access to the biasing springs from a location forward of the latch mount.

2. The cabled receptacle connector of claim 1, wherein the latch is movable axially relative to the receptacle housing.

3. The cabled receptacle connector of claim 1, wherein the latch includes a pivot axle coupled to the receptacle housing, the latch being rotatable about the pivot axle, the receptacle housing being slidably coupled to the pivot axle.

4. The cabled receptacle connector of claim 1, wherein the receptacle cage includes a latching guide at the rear being separate and discrete from the plurality of walls, the latching guide including a latching feature, the latch having a latching tab latchably coupled to the latching feature of the latching guide to secure the cabled receptacle connector in the receptacle cage.

5. The cabled receptacle connector of claim 4, wherein the latching guide includes a first side wall and a second side wall, each of the first and second side walls including a cutout and a mounting block axially offset form the cutout, the cutout configured to receive a second mounting block of a second latching guide of an adjacent cabled receptacle connector, the mounting block configured to be received in a second cutout of the second latching guide of the adjacent cabled receptacle connector.

6. The cabled receptacle connector of claim 1, wherein the biasing spring forward biases the receptacle housing until the receptacle housing engages a stop surface of the receptacle cage to locate the receptacle housing relative to the receptacle cage.

7. A cabled receptacle connector for a receptacle assembly comprising:

a cable assembly including a frame holding contacts, the contacts being terminated to cables of the cable assembly;

a receptacle housing having a cavity extending between a front and a rear of the receptacle housing, the receptacle housing having a mating slot at the front, the cavity receiving the cable assembly with the contacts positioned in the mating slot for mating engagement with a pluggable module removably received in a receptacle cage of the receptacle assembly, the receptacle housing including a latch mount and a cover removably coupled to the latch mount, the receptacle housing including a latch plate coupled to the latch mount and the cover to secure the cover to the latch mount;

a latch coupled to the receptacle housing, the latch having a latching tab configured to be latchably coupled to the receptacle cage; and a biasing spring having a first end coupled to the latch and a second end coupled to the cover of the receptacle housing, the biasing spring forward biasing the receptacle housing in the receptacle cage when the latching tab is latchably coupled to the receptacle cage, wherein the biasing spring has a forward biasing force exceeding a mating force of the pluggable module with the cabled receptacle connector to maintain the receptacle housing in the forward biased position during mating of the pluggable module with the cabled receptacle connector.

8. The cabled receptacle connector of claim 7, wherein the cover includes access ports in the latch mount aligned with the biasing springs, the access ports providing access to the biasing springs from a location forward of the latch mount.

9. The cabled receptacle connector of claim 7, wherein the biasing spring forward biases the receptacle housing until the receptacle housing engages a stop surface of the receptacle cage to locate the receptacle housing relative to the receptacle cage.

10. A receptacle assembly comprising:

a receptacle cage having a plurality of walls defining a module channel extending between a front and a rear of the receptacle cage, the plurality of walls including a top wall, a first side wall extending from the top wall to a bottom of the receptacle cage and a second side wall extending from the top wall to the bottom, wherein the module channel is open at the front to receive a pluggable module therein, the module channel being open at the rear, the receptacle cage having a latching guide at the rear including a latching feature, the latching guide being separate and discrete from the plurality of walls, the latching guide being coupled to the first side wall and the second side wall; and a cabled receptacle connector received in the module channel at the rear of the receptacle cage, the cabled receptacle connector comprising:

a cable assembly including a frame holding contacts, the contacts being terminated to cables of the cable assembly, the contacts having mating ends configured to be mated with the pluggable module;

a receptacle housing having a cavity extending between a front and a rear of the receptacle housing, the receptacle housing having a mating slot at the front, the cavity receiving the cable assembly with the contacts positioned in the mating slot for mating engagement with the pluggable module;

a latch coupled to the receptacle housing, the latch having a latching tab latchably coupled to the latching feature of the latching guide to secure the cabled receptacle connector in the receptacle cage; and a biasing spring having a first end coupled to the latch and a second end coupled to the receptacle housing, the biasing spring forward biasing the receptacle housing in the receptacle cage when the latching tab is latchably coupled to the latching feature.

11. The receptacle assembly of claim 10, wherein the receptacle housing includes a latch mount and a cover removably coupled to the latch mount, the second end of the biasing spring engaging the cover, the receptacle housing including a latch plate coupled to the latch mount and the cover to secure the cover to the latch mount.

12. The receptacle assembly of claim 11, wherein the cover includes access ports in the latch mount aligned with the biasing springs, the access ports providing access to the biasing springs from a location forward of the latch mount.

13. The receptacle assembly of claim 10, wherein the latching guide includes a first side wall and a second side wall, each of the first and second side walls including a cutout and a mounting block axially offset form the cutout, the cutout configured to receive a second mounting block of a second latching guide of an adjacent cabled receptacle connector, the mounting block configured to be received in a second cutout of the second latching guide of the adjacent cabled receptacle connector.

14. The receptacle assembly of claim 10, wherein the top wall of the receptacle cage includes a positioning tab extending into the module channel to engage a top of the receptacle housing to position the receptacle housing in the module channel spaced apart from the top wall such that an airflow channel is defined between the top of the receptacle housing and the top wall.

15. The receptacle assembly of claim 10, wherein the biasing spring has a forward biasing force exceeding a mating force of the pluggable module with the cabled receptacle connector to maintain the receptacle housing in the forward biased position during mating of the pluggable module with the cabled receptacle connector.

16. A communication system comprising:

a pluggable module having a pluggable body holding a module circuit board at a mating end of the pluggable module; and a receptacle assembly comprising a cabled receptacle connector and a receptacle cage receiving the cabled receptacle connector and the pluggable module;

the receptacle cage having a plurality of walls defining a module channel extending between a front and a rear of the receptacle cage, the plurality of walls including a top wall, a first side wall extending from the top wall to a bottom of the receptacle cage and a second side wall extending from the top wall to the bottom, wherein the module channel is open at the front to receive the pluggable module therein, the module channel being open at the rear to receive the cabled receptacle connector therein, the receptacle cage having a latching guide at the rear including a latching feature;

the cabled receptacle connector comprising:

a cable assembly including a frame holding contacts, the contacts being terminated to cables of the cable assembly, the contacts having mating ends configured to be mated with the module circuit board of the pluggable module;

a receptacle housing having a cavity extending between a front and a rear of the receptacle housing, the receptacle housing having a mating slot at the front receiving the module circuit board of the pluggable module, the cavity receiving the cable assembly with the contacts positioned in the mating slot for mating engagement with the module circuit board of the pluggable module, the receptacle housing including a latch mount and a cover removably coupled to the latch mount, the receptacle housing including a latch plate coupled to the latch mount and the cover to secure the cover to the latch mount;

a latch coupled to the receptacle housing, the latch having a latching tab latchably coupled to the latching feature of the latching guide to secure the cabled receptacle connector in the receptacle cage; and a biasing spring having a first end coupled to the latch and a second end coupled to the cover of the receptacle housing, the biasing spring forward biasing the receptacle housing in the receptacle cage when the latching tab is latchably coupled to the latching feature.

17. The communication system of claim 16, wherein the cover includes access ports in the latch mount aligned with the biasing springs, the access ports providing access to the biasing springs from a location forward of the latch mount.

18. The communication system of claim 16, wherein the latching guide is separate and discrete from the plurality of walls.

19. The communication system of claim 18, wherein the latching guide includes a first side wall and a second side wall, each of the first and second side walls including a cutout and a mounting block axially offset form the cutout, the cutout configured to receive a second mounting block of a second latching guide of an adjacent cabled receptacle connector, the mounting block configured to be received in a second cutout of the second latching guide of the adjacent cabled receptacle connector.

20. The communication system of claim 16, wherein the top wall of the receptacle cage includes a positioning tab extending into the module channel to engage a top of the receptacle housing to position the receptacle housing in the module channel spaced apart from the top wall such that an airflow channel is defined between the top of the receptacle housing and the top wall.

* * * * *